US005432591A

United States Patent [19]

Geleynse

[11] Patent Number: 5,432,591

[45] Date of Patent: Jul. 11, 1995

[54] MULTI-PURPOSE FOAM ROLLER IN A LIQUID TONER DEVELOPER

[75] Inventor: Carl D. Geleynse, Eagle, Id.

[73] Assignee: Hewlett-Packard Company, Palo Alto, Calif.

[21] Appl. No.: 193,687

[22] Filed: Feb. 7, 1994

[51] Int. Cl.[6] ..... G03G 15/10

[52] U.S. Cl. ..... 355/256; 118/661; 355/259; 355/260

[58] Field of Search ..... 355/256, 260, 259, 245, 355/297; 430/118–119, 125; 118/661, 659, 651, 647; 15/256.52

[56] References Cited

U.S. PATENT DOCUMENTS

| | | | |
|---|---|---|---|
| 4,299,902 | 11/1981 | Soma et al. | 430/125 |
| 4,325,627 | 4/1982 | Swidler et al. | 355/256 |
| 4,395,113 | 7/1983 | Buchan et al. | 355/297 |
| 4,512,658 | 4/1985 | Winkelmann | 355/230 |
| 4,627,705 | 12/1986 | Landa et al. . | |
| 4,801,965 | 1/1989 | Mochizuki et al. . | |
| 4,905,047 | 2/1990 | Ariyama | 355/256 |
| 5,300,990 | 4/1994 | Thompson | 355/256 |

FOREIGN PATENT DOCUMENTS

| | | | |
|---|---|---|---|
| 0070579 | 6/1981 | Japan | 355/256 |
| 0185464 | 11/1982 | Japan | 355/256 |
| 0080273 | 4/1991 | Japan | 355/256 |
| 0132682 | 6/1991 | Japan | 355/256 |
| 4151683 | 5/1992 | Japan | 355/256 |

*Primary Examiner*—A. T. Grimley
*Assistant Examiner*—Thu A. Dang

[57] ABSTRACT

A liquid toner electrophotographic printer includes a movable photoconductor surface, a developer roller, a squeegee roller, a liquid toner cartridge having a supply of liquid toner and a rotatable foam roller, and a transport mechanism including a carriage and air cylinder driven actuation system. The squeegee roller is rotatably mounted on the printer for movement between a first position wherein the squeegee roller is in contact with the photoconductor surface, wherein a drip line of liquid toner forms therebetween, and a second position wherein the squeegee roller is spaced away from the photoconductor. The transport mechanism moves the cartridges between a first position wherein the cartridge foam roller is in contact with the squeegee roller and the developer roller to remove excess liquid toner therefrom and a second position wherein the foam roller is in contact with the photoconductor surface and the squeegee roller, downstream of the squeegee roller, to remove the drip line from the photoconductor surface and the squeegee roller when the squeegee roller is in the second position.

14 Claims, 4 Drawing Sheets

MULTI-PURPOSE FOAM ROLLER IN A LIQUID TONER DEVELOPER

BACKGROUND OF THE INVENTION

This invention relates generally to a liquid toner developer system in an electrophotographic printer and more particularly to a multi-purpose foam roller therein for removing excess liquid toner.

Electrophotographic printers or copiers using liquid toner have difficulty keeping the unit, and more particularly the photoconductor surface, free from excess liquid toner. Ideally, the liquid toner dispensal and development system is a closed loop system, with any excess toner not required by the image returned back to the system. Because of the properties of liquid toner, however, excess liquid toner can easily drip or run outside the ideal closed loop system.

The problems associated with excess liquid toner are particularly problematic in color printers and copiers where any excess liquid toner of any one color component, e.g., cyan, yellow, magenta, or black (CMYK), can adulterate the final image color. Controlling excess liquid toner in color printers and copiers is especially difficult where only a single developer station is used. If a single developer station is used, each individual color component is sequentially supplied to the developer station. Any residual amount of the previous color component that remains at the developer station mixes with the subsequent color component if not effectively removed.

One source of residual liquid toner is a "drip line" that forms between a photoconductor and a squeegee roller in a developer station. The squeegee roller, sometimes referred to as a "squeeze" roller, is placed downstream of a developer roller in contact with the photoconductor surface to remove any excess liquid from the photoconductor. An illustrative example of a developer station using a squeegee roller is shown in U.S. Pat. No. 4,801,965 issued to Mochizuki et al. Typically, the squeegee roller is rotatable in the same direction as the photoconductor to create a shear force therebetween. The shear force created by the squeegee roller "squeezes" out any excess liquid out of the liquid toner carried along the photoconductor surface. A buildup of the surface tension of the liquid results. This buildup, referred to herein as the "dripline," can remain even after the cessation of the toner supply.

The primary prior art method of removing excess toner does not address the drip-line. The primary cleaning as shown, for example, in Mochizuki, uses a foam roller downstream of the squeegee roller. The downstream foam roller does not address the drip-line, however. Similar approaches are taught in U.S. Pat. Nos. 4,905,047 and 4,627,705.

Accordingly, a need remains for a method of removing the drip line of liquid toner from an electrophotographic surface.

SUMMARY OF THE INVENTION

It is, therefore, an object of the invention to remove the drip line from an electrophotographic surface. A liquid toner electrophotographic printer including an improved developer unit is described. The printer includes a movable photoconductor surface. The photoconductor can be either a belt or cylinder type photoconductor. A developer roller is spaced in close proximity to the photoconductor surface for selectively transferring liquid toner to the photoconductor surface corresponding to the desired image. Assuming the photoconductor rotates in a clockwise rotational direction, the developer roller is rotatable in the opposite, counter-clockwise rotational direction. A squeegee roller is positioned downstream of the developer roller for removing excess liquid toner from the photoconductor surface. According to one aspect of the invention, the squeegee roller has a first position wherein the squeegee roller is in contact with the photoconductor surface wherein a drip line of liquid toner forms between the squeegee roller and the developer roller, and a second position wherein the squeegee roller is spaced apart from the photoconductor surface to allow the drip line to pass the squeegee roller. The roller is mounted on the printer for movement between the first and second positions. The squeegee roller is preferably rotatable in the same direction of movement as the developer roller.

In another aspect of the invention, the printer includes one or more squeegee roller is preferably rotatable in the same direction of movement as the developer roller.

In another aspect of the invention, the printer includes one or more multi-position movable liquid toner cartridge. The cartridge includes a frame, a liquid toner reservoir mounted on the frame, and means coupled to the reservoir for supplying liquid toner to the developer roller. The toner supplying means, in the preferred embodiment, includes a plenum and a pump connected thereto for supplying liquid toner thereto. Each cartridge preferably includes a separate color component, e.g., CYMK.

The cartridge further includes a foam roller mounted on the frame for rotational movement. The foam roller is used to absorb excess liquid toner not required by the photoconductor surface. A wringer roller is placed in contact with the foam roller for removing excess liquid toner held in the foam roller. The foam roller and wringer roller are positioned over the reservoir such that the excess liquid toner is returned back to the reservoir. The foam roller is rotated in the same direction as the developer roller to scrub and backplate the developer roller.

In a further aspect of the invention, a means for moving the cartridges between one of two positions is described. In the first position the foam roller is brought into contact with the squeegee roller and the developer roller to remove excess liquid toner therefrom. In the second position, however, the foam roller is placed in contact with the photoconductor surface and the squeegee roller, downstream of the squeegee roller, to remove the drip line from the photoconductor surface and the squeegee roller when the squeegee roller is in the second spaced-apart position.

The positioning means includes a carriage, and a plurality of stands adapted to receive the cartridges. The stands are slidably mounted on the carriage. The carriage is moved along in a linear motion by means of a motor driven leadscrew connected to the carriage. A first air cylinder moves the cartridges between the carriage and the first position, and a second air cylinder moves the cartridge between the carriage and the second position. The second cylinder further includes an arm that moves the squeegee roller to its second position simultaneously with moving the cartridge into its second position.

An advantage of the present invention is the ability to have a common squeegee roller for all color components in a color printer or copier.

A further advantage of the present invention is the encapsulation of the multi-purpose foam roller in a replaceable liquid toner cartridge.

The foregoing and other objects, features and advantages of the invention will become more readily apparent from the following detailed description of a preferred embodiment of the invention which proceeds with reference to the accompanying drawings.

DETAILED DESCRIPTION OF THE PREFERRED EMBODIMENT

Figure 1:
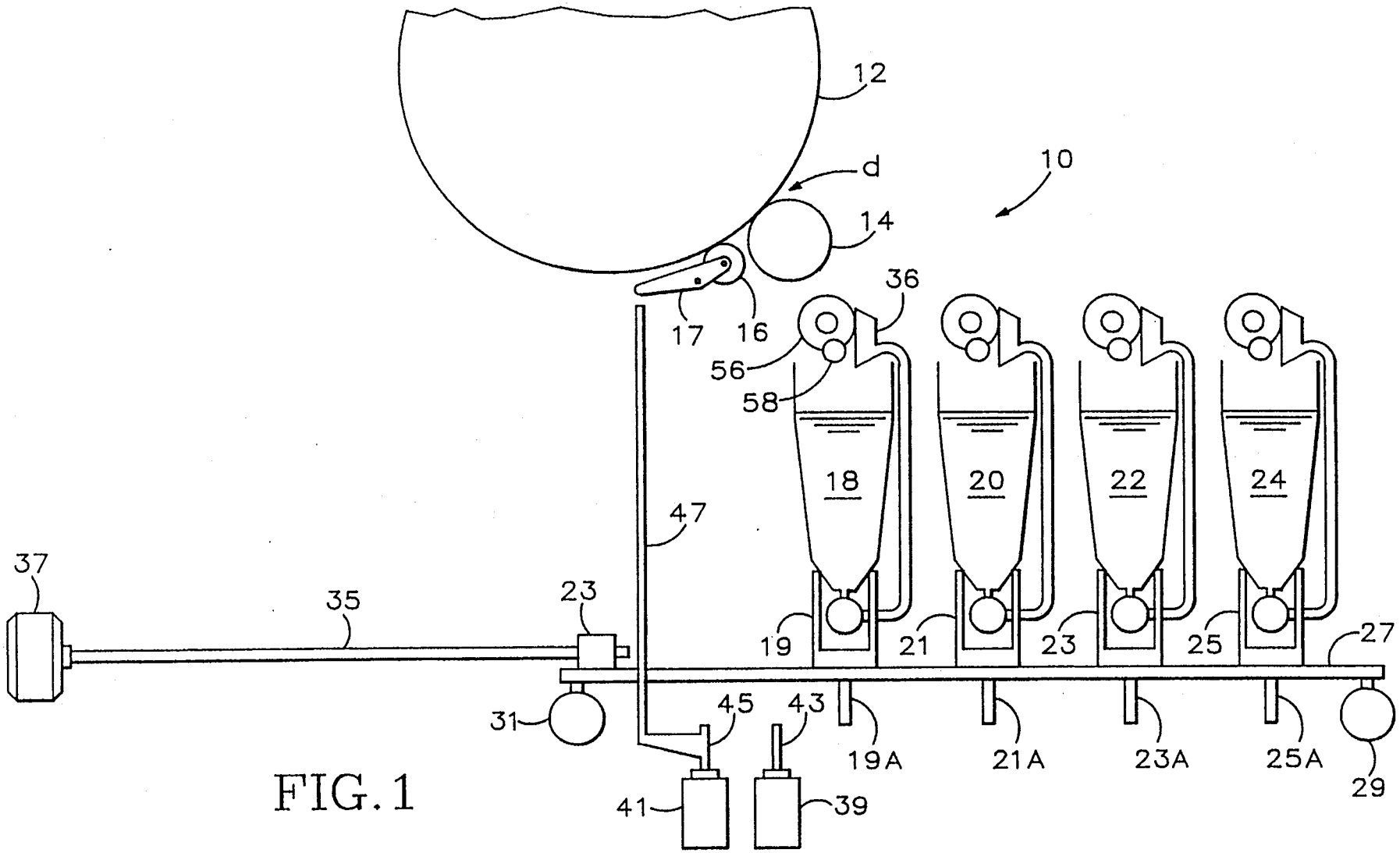
FIG. 1 is a liquid toner electrophotographic printer according to the invention.

Referring now to FIG. 1 a liquid toner electrophotographic printer is shown generally at 10. The printer includes a moveable photoconductor 12. The photoconductor 12 is shown as a cylindrical drum in FIG. 1, however, the principles employed herein apply equally to belt-type photoconductors. The photo-conductor operates in a conventional manner to receive a latent electrostatic image thereon. The means for generating the latent electrostatic image on the photoconductor is known in the art of electro-photography and is, therefore, not described herein.

The electrophotographic printer 10 also includes a developer roller 14 disposed in close proximity to the photoconductor surface for selectively transferring liquid toner to the photoconductor surface corresponding to the latent electrostatic image. Preferably, the developer roller 14 is separated by a distance "d" from the photoconductor 12 by about 50 to 75 microns (0.002–0.003 inches). The developer roll 14 is rotatable in the opposite direction of movement of the photoconductor surface. In the preferred embodiment, as shown in FIG. 1, the photoconductor 12 rotates in a clockwise direction whereas the developer roller 14 rotates in the counterclockwise direction. The precise rotational velocity of the developer roller 14 is greater than the rotational velocity of the photoconductor surface and is preferably approximately three times the rotational velocity of the photoconductor surface 12.

The developer roller is electrically biased to transfer the toner particles to the photoconductor surface. The biasing scheme chosen is a function of the photoconductor as well as the toner. Because the invention described herein applies to all liquid toner electrophotographic printers or copiers, the details of the electrophotographic process are not described herein. In a preferred embodiment, however, the biasing means and the liquid toner composition are those described in commonly assigned U.S. patent application Ser. No. 07/904,798 entitled LIQUID ELECTROPHOTOGRAPHIC PRINTER DEVELOPER, which is incorporated herein by reference.

Figure 3:
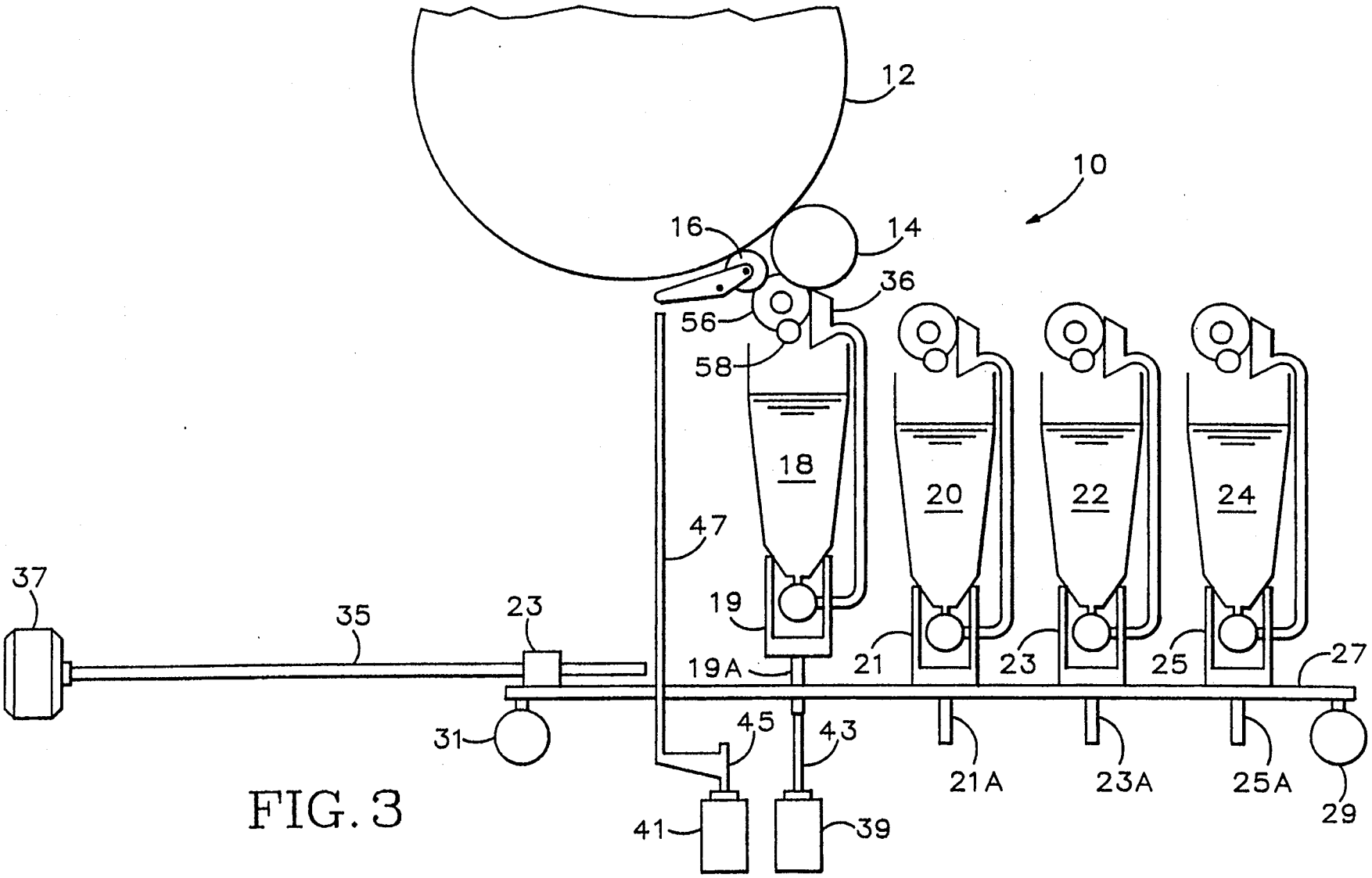
FIG. 3 is the printer of FIG. 1 wherein a foam roller of a first liquid toner cartridge is engaged with a developer roller and the corresponding foam roller is in the first position.

The printer 10 further includes a squeegee roller 16. The squeegee roller 16, is mounted on the printer for pivotal movement between a first position wherein the squeegee roller 16 is in contact with the photoconductor surface, as shown in FIG. 1, and a second position wherein the squeegee roller is spaced apart from the photoconductor surface to allow the drip line to pass, as shown in FIG. 3 below. The squeegee roller 16 is mounted on the printer by a pair of triangular shaped mounting brackets 17 at opposite ends of the roller. The roller 16 is normally biased into the first position, i.e., against the photoconductor surface 12, by a biasing means (not shown) such as a spring. If a spring is employed as the biasing means, a compression spring is connected to the bracket to urge the squeegee roller 16 into contact with the photoconductor surface 12.

In the preferred embodiment, the squeegee roller 16 is rotatable in the same direction of movement as the developer roller 14. Preferably, in the first position, the squeegee roller 16 is not driven, but rides instead with the movement of the photoconductor 12. In this way, the squeegee roller 16 does not tend to smear the latent image on the photoconductor surface. Alternatively, the squeegee roller 16 can be driven in cooperation with the photoconductor by a clutch mechanism to drive the photoconductor and the squeegee roller at approximately the same angular velocity.

Electrophotographic printer 10 also includes four liquid toner cartridges 18, 20, 22, and 24. Each cartridge contains a supply or reservoir of liquid toner, a foam roller, a wringer roller, and means for supplying liquid toner to the developer roller. The preferred embodiment of the cartridges is described below with reference to FIGS. 2A and 2B. In the preferred embodiment, the four cartridges 18–24 contain yellow, magenta, cyan, and black liquid toner, respectively. The process of the invention applies equally to electrophotographic systems having any number of color components including monochrome systems.

The cartridges 18, 20, 22, and 24 are received in a corresponding stand 19, 21, 23, and 25, respectively. The stands are adapted to receive the corresponding cartridge in a secure manner to avoid spilling the liquid toner when the cartridge is engaged with the developer roller, as hereinafter described. The stands, however, further allow the cartridges to be easily replaced when the liquid toner supply is emptied therefrom. The stands can take on any number of forms, including being integrally formed with the cartridge, as is known to those skilled in the art, and is therefore not described in any further detail. The scope of the invention includes all stands that are capable of securely holding a cartridge.

Each stand 19, 21, 23, and 25 includes an actuation member 19A, 21A, 23A, and 25A, respectively, extending away from a bottom side thereof. The length of the actuation members is determined by the amount of vertical travel necessary to engage the cartridges with the photoconductor 12. At a minimum, the length of the actuation members must be greater than the cartridge travel plus the thickness of a carriage 27 in order for the actuation member to be retained in the carriage through its entire travel. The stands are slidably mounted on the carriage 27 within slots (not shown) formed in the carriage for receiving the stand actuation members.

The carriage includes wheels 29 and 31 for linear movement of the carriage. The carriage further includes a nut 33 fixedly mounted on a distal end thereof for receiving a leadscrew 35. The leadscrew 35 is driven by a motor 37 to rotate the leadscrew in both the forward and reverse directions. Once the leadscrew is received in the nut, the carriage moves linearly along the axis of the leadscrew responsive to the rotation of the leadscrew. The direction of the carriage, i.e., towards or away from the motor, is determined by the direction of rotation of the leadscrew.

The printer 10 further includes air cylinders 39 and 41. Air cylinder 39 includes a push rod 43 and air cylinder 41 includes a push rod 45. Push rod 45 further includes an elongate arm 47 for engaging bracket 17 to move the squeegee roller between its first and second positions, as described below. Air cylinder 39 engages a stand, when positioned directly over the push rod 43, to engage the corresponding cartridge with the developer roller 14. The air cylinder 41 has the dual purpose of bringing the foam roller in contact with the photoconductor surface while simultaneously separating the squeegee roller 16 from the photoconductor surface to allow the drip line to pass. Alternatively, a single air cylinder or other equivalent lifting means can be used with the appropriate linkage in place of the two separate air cylinders. The precise operation of the air cylinders will become more clear when the operation of the printer is described below.

Figure 2A:
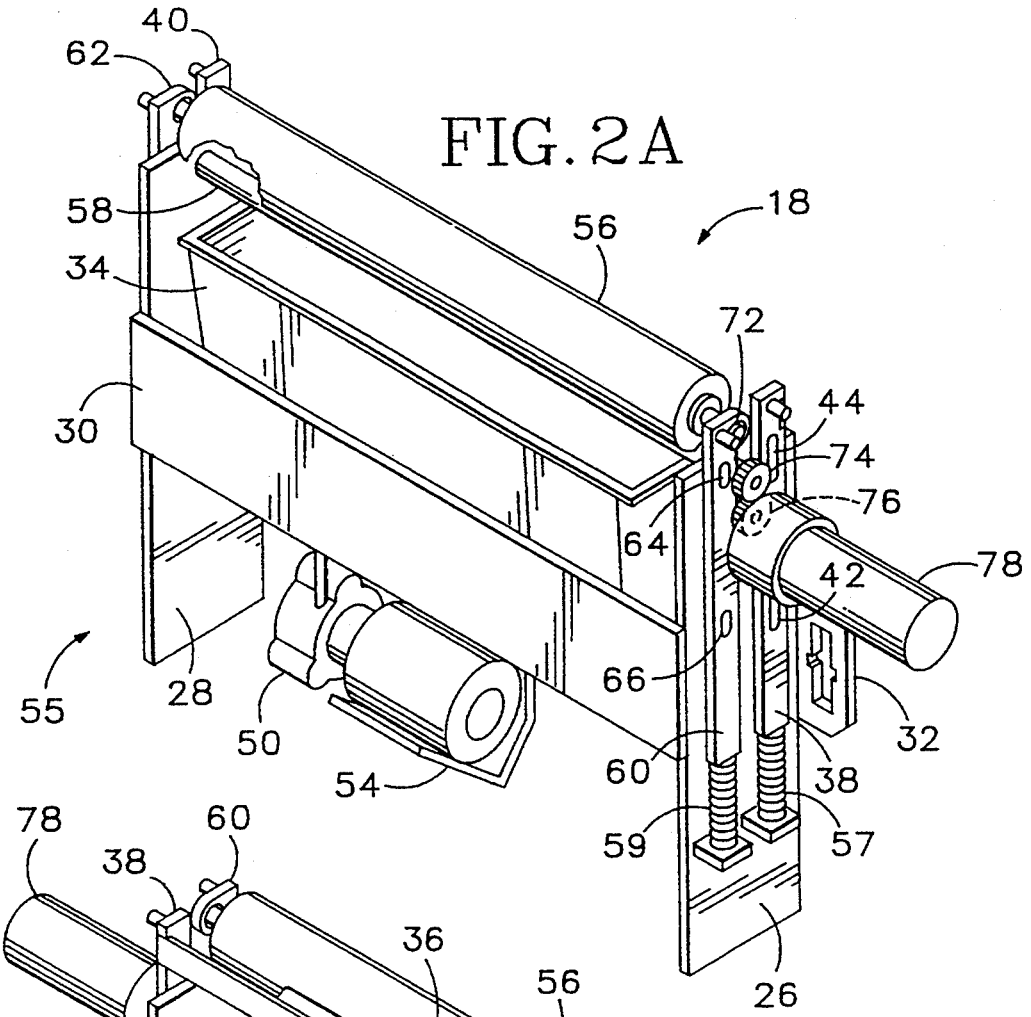
FIGS. 2A and 2B are perspective views of a liquid toner cartridge according to the invention.
Figure 2B:
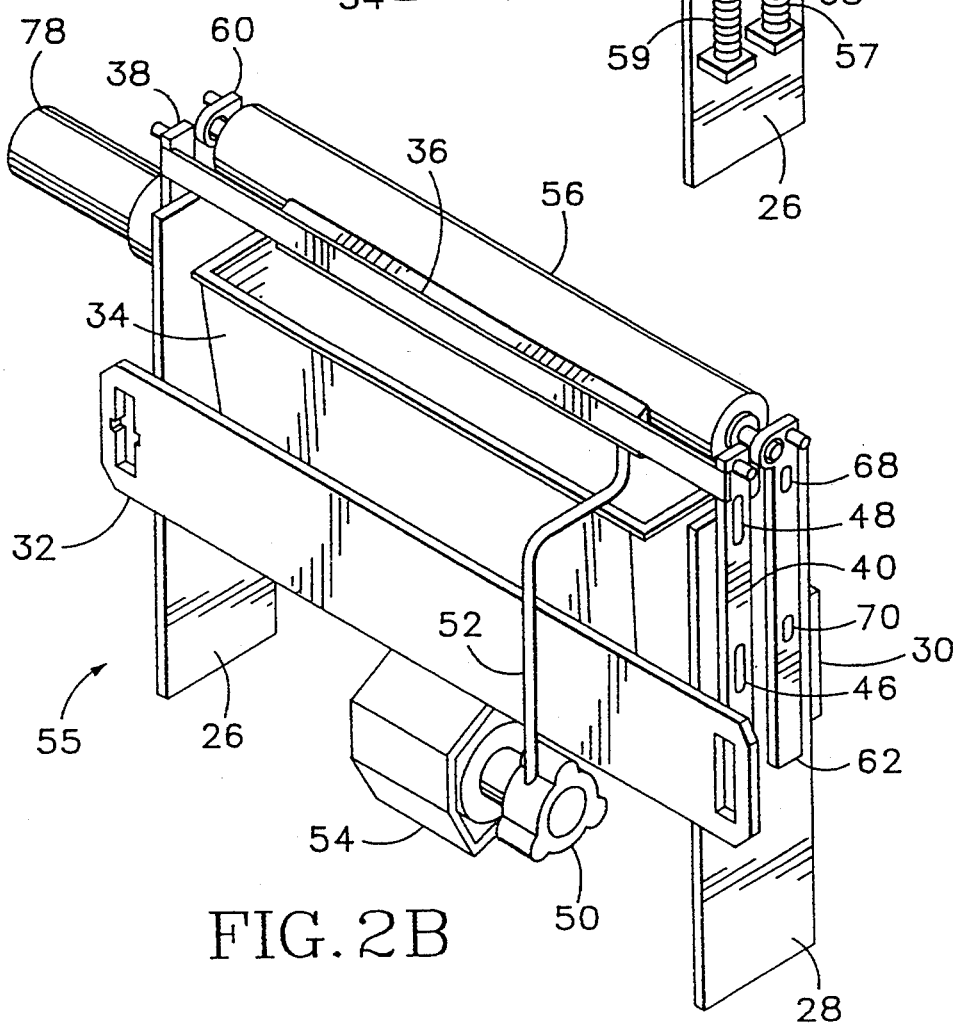

Referring now to FIGS. 2A and 2B, cartridge 18 is shown in detail. Cartridges 20, 22 and 24 are substantially identical to cartridge 18 and therefore is not described herein. The only difference between the cartridges is the particular color of toner located therein. Cartridge 18 includes a frame 55 comprising vertical support members 26 and 28 and horizontal crossmembers 30 and 32 attached thereto. The frame provides the structural integrity of the cartridge 18, as well as providing a means of engagement for the corresponding cartridge stand.

Mounted on the frame is a reservoir 34 for storing liquid toner therein. The reservoir has an opening in the top to receive excess toner, as described further below. An elongate plenum 36 is slidably connected to the frame by means of vertical slide members 38 and 40. Slide member 38 is slidably connected to vertical member 26 by screws or studs (not visible) received in slots 42 and 44 in slide member 38. Similarly, slide member 40 is slidably connected to vertical member 28 by screws or studs (not shown) received in slots 46 and 48. The length of slots 42, 44, 46 and 48 are substantially equal and determine the vertical path of travel of the plenum.

The plenum 36 is biased upwards into a biased position by a compression spring 57 connected between slide member 38 and vertical member 26. A second optional compression spring (not shown) can also be connected to slide member 40 to provide a uniform upward force to the plenum 36. The spring 57 urges the plenum into proximity to the developer roller when the cartridge is engaged with the developer roller 14. As is apparent to those skilled in the art, other means for urging the plenum upward are possible, e.g., a tension spring, and thus fall within the scope of this invention.

The plenum 36 is a trough for supplying liquid toner to the developer roller 14 when the cartridge 18 is engaged with the developer roller 14, as described further below. Thus, in the case of the printer 10, the length of the plenum 36 must be equal to or greater than the width of the desired image. The liquid toner is supplied to the plenum 38 by means of a toner pump 50 via a conduit 52 coupled therebetween. The pump is connected to the reservoir 34 at an outlet (not shown) at the base of the reservoir. A pump motor 54 is operatively coupled to the pump 50 in a conventional manner to generate a pressure sufficient to supply the liquid toner to the plenum. In the preferred embodiment, the plenum is maintained substantially full when the cartridge is engaged with the developing unit to ensure a constant supply of toner to the developer roller.

The cartridge 18 further includes a foam roller 56 and a ringer roller 58 mounted on the frame. The foam roller is slidably mounted on the frame by means of vertical slide members 60 and 62. Vertical members 60 and 62 are in turn slidably connected to vertical members 26 and 28, respectively. Slide member 60 is slidably connected to vertical member 26 by means of screws or studs received in slots 64 and 66 formed longitudinally therein. As with slots 42 and 44 in member 38, slots 64 and 66 limit the vertical travel of the slide member 60, and therefore the foam roller. Slide member 62 is slidably connected to vertical member 28 in a substantially identical manner as slide member 60, i.e., by screws or studs received in longitudinal slots 68 and 70. As with the plenum 26, the foam roller 56 is biased upwards by a compression spring 59 connected between slide member 60 and vertical member 26.

The foam roller 56 is rotatably mounted on slide members 60. The foam roller 56 is mounted on the vertical members 60 and 62 by means of a longitudinal axis 72 in the foam roller received in journaled bores formed in the slide members 60 and 62. The foam roller axis extends beyond the foam roller sufficiently to extend through the bores in the vertical members 60 and 62.

In the preferred embodiment, the foam roller 56 is made of a polyurethane material having a porosity of approximately 100 pores per inch. The polyurethane foam roller allows an electrical bias to be applied thereto to assist in removing excess toner from the developer roller and squeegee roller when engaged therewith, as described below. Preferably, the electrical bias is at a level less than the developer roller 14 and the squeegee roller 16 in order to attract or remove toner from both rollers for redispersion of the toner removed therefrom in the toner reservoir 34.

The ringer roller 58 is rotatably mounted on vertical members 26 and 28 such that the ringer roller lies parallel to the surface of foam roller 56. The ringer roller 58 is connected to vertical members 26 and 28 by means of journaled slots or bores formed in the vertical members to receive a ringer roller axis. The ringer roller 58 is positioned parallel to the foam roller such that when the foam roller 56 is brought into contact with the ringer roller 58 the ringer roller compresses the foam roller 56 to remove excess toner held therein. The ringer roller 58 is not kept in permanent contact with the foam roller, however, to avoid creating a permanent depression in the foam roller 56 in the event the ringer roller 58 is maintained at the same position along the foam roller for an extended period of time. Alternatively, however, the ringer roller can be mounted to the vertical members 60 and 62 substantially parallel to and in contact with the foam roller such that the foam roller and ringer roller move in unison responsive to movement of the vertical members 60 and 62.

Gears 74 and 76 are mounted to the frame for driving the foam roller 56. The first gear 74 is connected to the wringer roller axis (not shown) for rotational movement therewith. The second gear 76 is connected to a shaft of a motor 78 mounted on vertical member 26. The second gear 76 is engaged with the first gear 76. Actuation of the motor 78 therefore drives gear 76 which thus causes wringer roller 58 to rotate. The rotation of wringer roller 58 causes the foam roller 56 to rotate when the foam roller 56 is in contact with the wringer roller ,58. Alternatively, the motor 78 can be connected to drive the foam roller 56 whereby the wringer roller 58 would rotate responsive to the foam roller 56 being driven. By driving the wringer roller 58, however, a lower torque motor can be used. Other gear systems are possible, as is apparent to one skilled in the art, and are determined primarily by the desired rotational speeds of the foam roller 56.

OPERATION

In use, the printer sequences through the following steps respond to receipt of a print job. The following description assumes that each of the four color components are required by the print job. It may be, however, that only a subset of the color components are required. If so, only the cartridges containing the color components required by the print job are engaged with the developer roller 14. For completeness, however, the following description includes all four color components.

Figure 4:
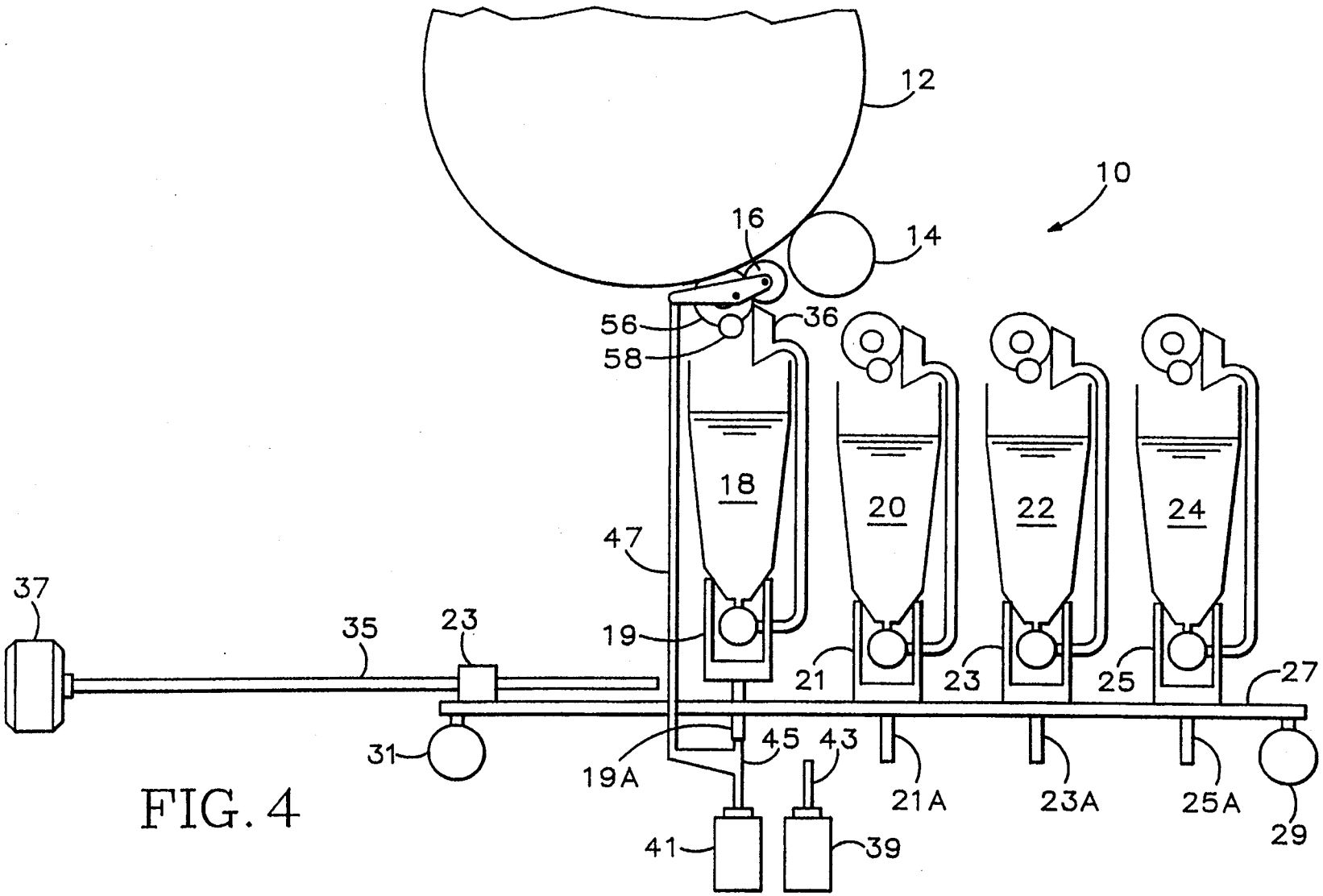
FIG. 4 is the printer of FIG. 1 wherein the foam roller of the first liquid toner cartridge is engaged with the photoconductor and the squeegee roller to remove the drip line formed therebetween.

Referring now to FIGS. 3 and 4, the operation of the foam roller 56 is shown. The toner cartridges in FIGS. 3 and 4, as in FIG. 1, are shown schematically so as to focus on the operation of the foam roller. From the default position shown in FIG. 1, the first step in the process is to position the actuation member 19A directly over pushrod 43. Once the actuation member 19A is aligned with the pushrod 43 the air cylinder 39 is then actuated thereby causing the pushrod 43 to move cartridge 18 towards the developer roller 14. The cartridge 18 is pushed until the foam roller 56 makes sufficient contact with the developer roller 14 and the squeegee roller 16. The resulting cartridge position is shown in FIG. 3. Once in place, the corresponding toner can then be transferred to the photoconductor 12 in the normal manner. Once the toner is transferred, the cartridge 18 is lowered back onto carriage 27 by air cylinder 39.

Next, the carriage 27 is moved so that the actuation member 19A is positioned over the pushrod 45. Once the actuation member 19A is aligned with pushrod 45 air cylinder 41 is actuated, thereby moving the cartridge to place the foam roller 56 in contact with the photoconductor surface 12 downstream of the squeegee roller 16. Actuation of the air cylinder 41 also causes arm 47 to push on mounting brackets 17 such that the squeegee roller 16 is spaced apart from the photo conductor surface. The plenum 36 is also kept from it normal bias position by a stop (not shown) that contacts the slide member 38 as the cartridge is brought into contact with the photoconductor 12. The stop restrains the slide members 38 and 40 from reaching their normally biased position. This position is shown in FIG. 4.

In the position shown in FIG. 4, the photoconductor is rotated whereby the drip line that had formed between the photoconductor and the squeegee roller is allowed to pass therealong and be absorbed by the foam roller 56. The foam roller is also in contact with the squeegee roller 16 and therefor cleans any excess toner from the squeegee roller 16 as well. The excess toner absorbed by the foam roller 56 is then wrung out by the ringer roller 58 and deposited back in the toner reservoir.

At the completion of the rotation of the photoconductor, the cartridge 18 is lowered back onto the carriage by air cylinder 41. This completes the cycle for cartridge 18. Thereafter the aforementioned steps are repeated with respect to each cartridge 20, 22, and 24. After each cartridge has gone through the affirmentioned steps, the carriage is returned back to the default position shown in FIG. 1 to await a subsequent print job. Although the above-described method involved four color components, the method applied equally as well where only a subset of the cartridges is used, such as in a black and white print job.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A developer station for a liquid toner electrophotographic printer having a photoconductor surface for receiving a latent electrostatic image formable thereon, the developer station comprising:

a developer roller for transferring liquid toner to the photoconductor surface corresponding to the image formed thereon, the developer roller revolving in counter-rotational direction with respect to the photoconductor surface;

a squeegee roller for removing excess liquid toner remaining on the photoconductor surface after completion of the transfer of the liquid toner from the developer roller, the squeegee roller being movable to a first position in which it is in contact with the photoconductor surface wherein a drip line of liquid toner is formed therebetween, and being further movable to a second position wherein the squeegee roller is spaced apart from the photoconductor surface, the squeegee roller being rotatable in the same direction of movement as the developer roller;

means for moving the squeegee roller between the respective first and second positions;

a liquid toner cartridge having a supply of liquid toner and a rotatable foam roller; and means for moving the cartridge between a first position wherein the foam roller is in contact with the squeegee roller and the developer roller to remove excess liquid toner therefrom and a second position wherein the foam roller is in contact with the photoconductor surface and the squeegee roller to remove the drip line when the squeegee roller is in the second position and the photoconductor surface is moved towards the foam roller to allow the drip line to be absorbed by the foam roller.

2. A developer station according to claim 1 wherein the means for moving the cartridge comprises:

a carriage;

a stand adapted to receive the cartridge, the stand slidably mounted on the carriage;

means for linearly moving the carriage;

means for moving the cartridge between the carriage and the first position; and means for moving the cartridge between the carriage and the second position.

3. A developer station according to claim 2 wherein the means for moving the cartridge further includes a plurality of stands adapted to receive a cartridge, each stand being slidably mounted on the carriage, and wherein the printer further includes:

a plurality of liquid toner cartridges received in a respective one of the stands, each cartridge including:

a frame;

a liquid toner reservoir mounted on the frame;

means coupled to the reservoir for supplying liquid toner to the developer roller;

a foam roller mounted on the frame for rotational movement in the same direction as the developer roller;

means in contact with the foam roller for removing excess liquid toner held in the foam roller and returning the removed liquid toner to the reservoir; and means for rotating the foam roller in the same direction as the developer roller.

4. A developer station according to claim 1 wherein the means for moving the squeegee roller between the respective first and second positions includes:

means for pivotally mounting the squeegee roller on the printer;

means for biasing the squeegee roller into the first position; and means for rotating the pivotally mounting means wherein the squeegee roller moves from the first position to the second position.

5. A developer station according to claim 4 wherein the means for rotating the pivotally mounting means wherein the squeegee roller moves from the first position to the second position includes:

an air cylinder having a push rod operatively connected thereto; and an elongate arm connected to the push rod, the distal end of the arm juxtaposed to the pivotally mounting means for contacting the pivotally mounting means responsive to actuation of the air cylinder.

6. A developer station according to claim 1 wherein the liquid toner cartridge further includes:

a frame having the foam roller mounted thereon for rotational movement in the same direction as the developer roller;

a liquid toner reservoir fixedly mounted on the frame for holding the supply of liquid toner;

means coupled to the reservoir for supplying liquid toner to the developer roller;

means for removing excess liquid toner held in the foam roller and returning the removed liquid toner to the reservoir; and means for rotating the foam roller.

7. A developer station according to claim 6 wherein the liquid toner reservoir includes a bath having an elongate opening in a top side thereof and a supply outlet, the bath being mounted on the frame such that the elongate opening extends substantially parallel to and under the foam roller to receive the excess toner removed by the removing means.

8. A developer station according to claim 7 wherein the supplying means includes:

an elongate plenum slidably connected to the frame for movement between a first position wherein the elongate opening is disposed in close proximity to the developer roller in to allow liquid toner to pass from the plenum lengthwise opening to the developer roller and a second position wherein the plenum is spaced away from the developer roller, the plenum having an inlet opening for receiving liquid toner and a lengthwise opening formed therein for supplying liquid toner to the developer roller;

a pump coupled to the bath supply outlet;

a conduit coupled between the pump and the plenum inlet opening for supplying liquid toner plenum; and a motor operatively coupled to the pump.

9. A developer station according to claim 8 wherein the supplying means further includes:

a first slide member coupled to a first distal end of the plenum, the first slide member having a guideline slot formed therein;

a second slide member coupled to a second distal end of the plenum, the slide vertical member having a guideline slot formed therein;

means for slidably connecting the slide members to the frame; and means for linearly moving the slide members wherein the plenum moves between the first position and the second position.

10. A developer station according to claim 6 wherein the foam roller includes a cylindrical roller having a length substantially equal to the width of the photoconductor surface.

11. A developer station according to claim 6 wherein the foam roller is made of a polyurethane.

12. A developer station according to claim 6 wherein means for removing excess liquid toner includes a wringer roller mounted to the frame substantially parallel to and in contact with the foam roller when the foam roller is in the first position.

13. A developer station according to claim 6 wherein means for moving the foam roller between the first position and the second position includes:

a first slide member coupled to a first distal end of the foam roller, the first slide vertical member having a guideline slot formed therein;

a second slide member coupled to a second distal end of the foam roller, the second slide member having a guideline slot formed therein;

means for slidably connecting the slide members to the frame; and means for linearly moving the slide members.

14. A developer station according to claim 13 wherein the means for linearly moving the vertical members includes a spring means coupled to at least one of the slide members.

* * * * *